US010299551B1

(12) United States Patent
Lai

(10) Patent No.: US 10,299,551 B1
(45) Date of Patent: May 28, 2019

(54) EXPANDABLE LUGGAGE

(71) Applicant: Wei-Hung Lai, Taichung (TW)

(72) Inventor: Wei-Hung Lai, Taichung (TW)

( * ) Notice: Subject to any disclaimer, the term of this patent is extended or adjusted under 35 U.S.C. 154(b) by 7 days.

(21) Appl. No.: 15/849,192

(22) Filed: Dec. 20, 2017

(51) Int. Cl.
*A45C 9/00* (2006.01)
*A45C 7/00* (2006.01)
*A45C 13/26* (2006.01)

(52) U.S. Cl.
CPC ..... *A45C 7/0022* (2013.01); *A45C 13/26* (2013.01)

(58) Field of Classification Search
CPC ... A45C 7/0022; A45C 7/0063; A45C 7/0031; A45C 7/0027
USPC ..... 206/316.2, 373; 220/755, 786, 324, 326; 224/413, 429; 292/111, 129, 333, 336; 383/2, 33, 40; 70/312, 64, 69, 70; 190/100, 10, 115
See application file for complete search history.

(56) References Cited

U.S. PATENT DOCUMENTS 5,080,206 A * 1/1992 Tawil ..... A45C 7/0022 190/103
5,324,115 A * 6/1994 Weinreb ..... A45C 7/0068 190/103
5,390,811 A * 2/1995 Ogino ..... B65D 21/0223 206/445
5,671,831 A * 9/1997 Chiu ..... A45C 5/14 190/103
5,931,270 A * 8/1999 Mitchell ..... A45C 13/26 150/108
6,223,960 B1 * 5/2001 Powell ..... B62J 9/00 190/125
6,276,552 B1 * 8/2001 Vervisch ..... F16K 35/10 220/315
2002/0108981 A1 * 8/2002 Smith ..... A45C 7/0045 224/427
2002/0117414 A1 * 8/2002 Kipper ..... B25H 3/023 206/373
2003/0188945 A1 * 10/2003 Lee ..... A45C 13/10 190/119
2007/0102469 A1 * 5/2007 Roth ..... A45C 7/0063 224/413
2014/0216876 A1 * 8/2014 Cavalheiro ..... A45C 9/00 190/15 R
2015/0040622 A1 * 2/2015 Meersschaert ..... E05B 35/105 70/69

* cited by examiner

*Primary Examiner* — Fenn C Mathew
*Assistant Examiner* — Cynthia F Collado
(74) *Attorney, Agent, or Firm* — Wang Law Firm, Inc.

(57) ABSTRACT

An expandable luggage includes a first case member, a second case member, and a flexible member with opposite ends connected to the first and the second case members to form a chamber. The expandable luggage further includes a controller, which has a first member fixed to the first case member, a second member fixed to the second case member. The first member is movably connected to the second member to be moved between a first position and a second position. The first member is engaged with the second member when the first member is moved to the first position. The chamber is narrowed when the first case member is moved toward the second case member, and the controller is locked automatically. The controller further includes an unlocking device to be operated to disengage first member with the second member if the chamber is expanded.

12 Claims, 7 Drawing Sheets

EXPANDABLE LUGGAGE

BACKGROUND OF THE INVENTION

1. Technical Field

The present invention relates to a luggage, and more particularly to an expandable luggage.

2. Description of Related Art

Typically, conventional luggage each has fixed size. A user usually has plural pieces of luggage with various sizes that he/she may pick the luggage with specified size according to the trip.

An improved luggage was invented which is capable of expanding its size. Such luggage has a first case member, a second case member, and a flexible member with opposite ends connected to the first and the second case members respectively. The luggage further is provided with a zipper on edges of the first and the second case members. When the zipper is zipped, the first case member is moved toward the second case member and the flexible is warped, so that the luggage has a small chamber to store goods, and when the zipper is unzipped, the first case member is moved away from the second case member and the flexible is straightened, so that the luggage has a large chamber to store goods.

For this kind of expandable luggage, the zipper extends around the entire luggage, so that there is a long distance to go when the zipper is zipped or unzipped, and that is troublesome to the user.

BRIEF SUMMARY OF THE INVENTION

In view of the above, the primary objective of the present invention is to provide an expandable luggage, which provides an easy way of expanding and narrowing the luggage.

In order to achieve the objective of the present invention, an expandable luggage includes a first case member, a second case member, and a flexible member with opposite ends connected to the first and the second case members to form a chamber between the first and the second case members. The expandable luggage further is provided with a controller, which has a first member fixed to the first case member, a second member fixed to the second case member and in association with the first member, and an unlocking device. The first member has a latch member with a hook. The second member has an entrance at an end thereof and a locking member with a stop portion inside the entrance. The first member is inserted into the second member via the entrance to be moved between a first position, at which the first member is closed to the second member and the hook of the latch member engages the stop portion of the locking member to secure the first member at the first position, and a second position, at which the first member is moved away from the second member.

The unlocking device is provided at the first member or the second member to be operated to disengage the hook of the latch member with the stop portion of the locking member when the first member is at the first position, whereby the first member is able to be moved to the second position.

When the first member is moved to the first position, the first case member is moved toward the second case member to narrow the chamber; and when first member is moved to the second position, the first case member is moved away from the second case member to expand the chamber.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
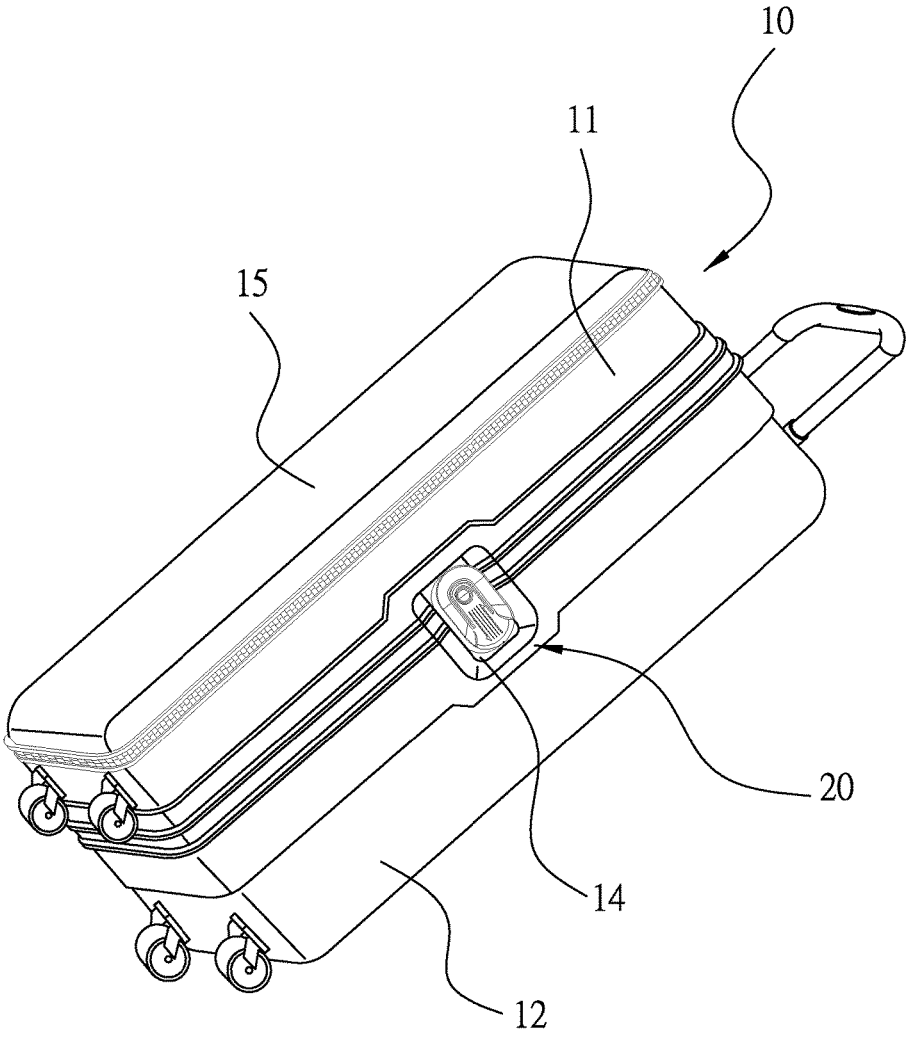
FIG. 1 is a perspective view of a first preferred embodiment of the present invention, showing the luggage being narrowed.
Figure 2:
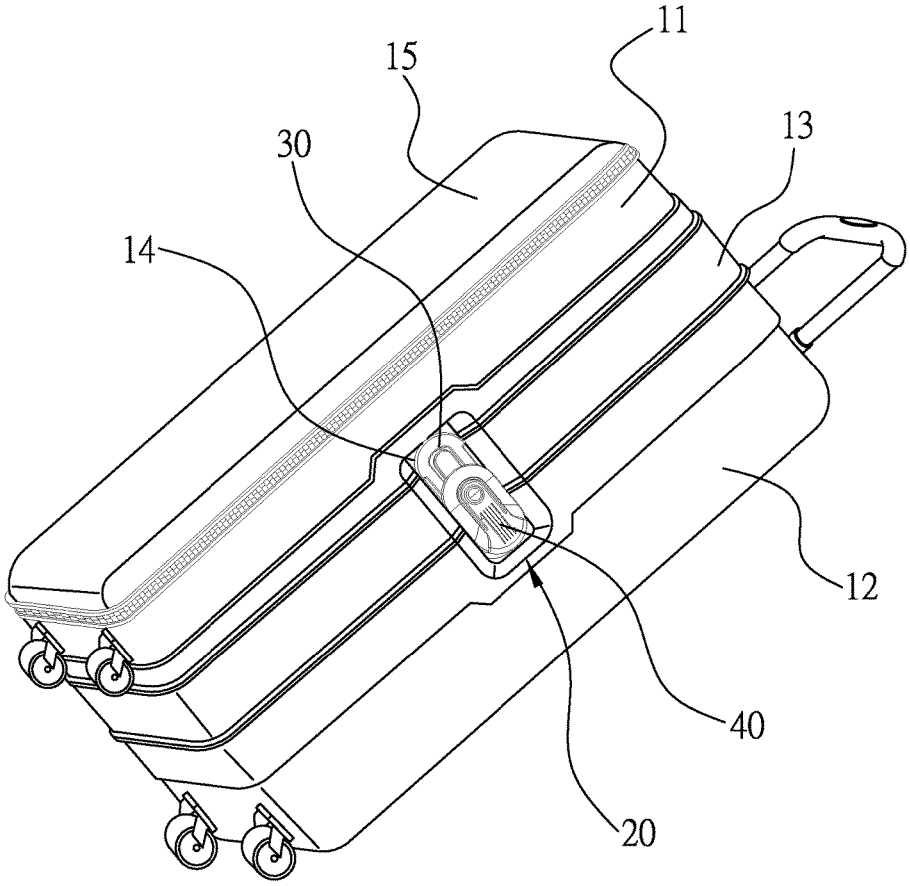
FIG. 2 is a front view of the first preferred embodiment of the present invention, showing the luggage being expanded.

As shown in FIG. 1 and FIG. 2, an expandable luggage of the first preferred embodiment of the present invention includes a luggage 10 and a plurality of controllers 20 (only one of the controllers 20 is shown in drawings). The luggage 10 includes a first case member 11, a second case member 12, and a flexible member 13 with opposite ends connected to the first and the second case members 11 and 12 to form a chamber therein to store goods. The first case member 11 is provided with a lid 15 which is able to be opened to put goods into the chamber or take goods out of the chamber. The first and the second case members 11 and 12 are provided with recesses 14. The recesses 14 of the first case member 11 are in association with the recesses 14 of the second case member 12. Each of the controllers 20 has a first member 30 and a second member 40. The first members 30 are received in the recesses 14 of the first case member 11 while the second members 40 are received in the recesses 14 of the second case member 12 and in association with the first members 30 respectively. Heights of the controllers are equal to or lowered to depths of the recesses 14 to reduce the risk of the controllers 20 being operated by accident. The controllers 20 are the same, so we only describe one of which for example hereunder.

Figure 3:
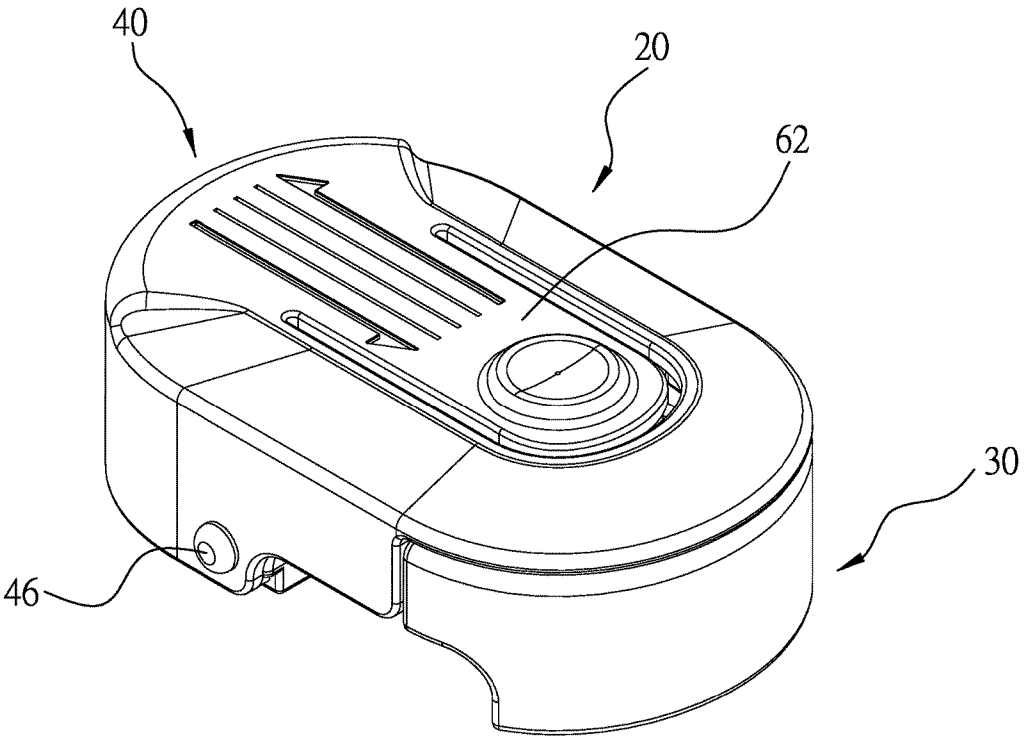
FIG. 3 is a perspective view of the controller of the first preferred embodiment of the present invention.
Figure 4:
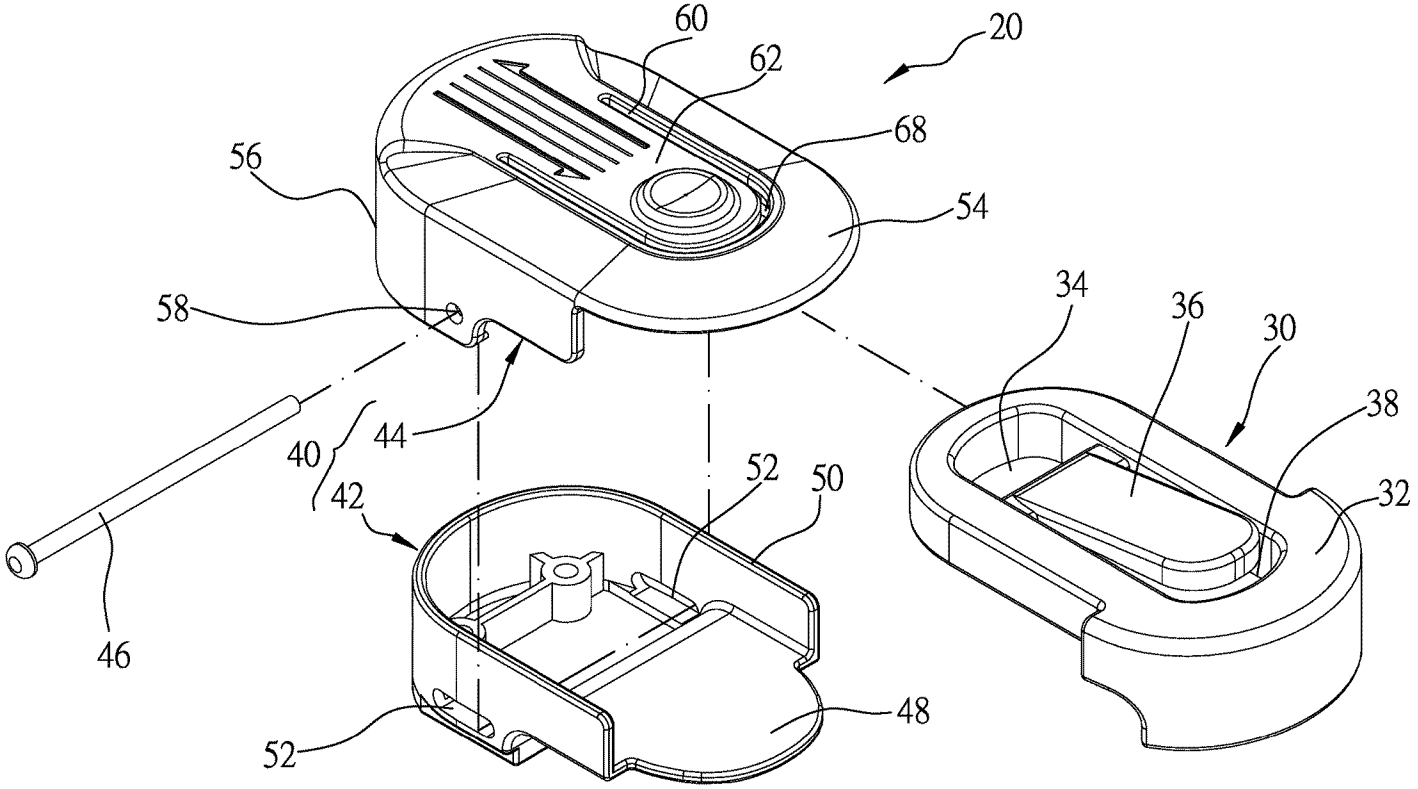
FIG. 4 is an exploded view of the controller of the first preferred embodiment of the present invention.

As shown in FIG. 3 and FIG. 4, the first member 30 of the controller 20 has a main body 32 with an opening 34. The main body 32 is fixed to the first case member 11. The first member 30 further has a latch member 36 in the opening 34. The locking member 36 has an end connected to the main body 32 and a distal end suspended. The latch member 36 has a hook 38 at the distal end.

The second member 40 of the controller 20 includes a base 42, a cover 44, and a pin 46. The base 42 has a bottom plate 48 and a U-shaped sidewall 50 connected to an edge of the bottom plate 48. The bottom plate 48 is fixed to the second case member 12. The sidewall 50 is provided with a pair of elongated slots 52. The cover 44 has a top plate 54 and a U-shaped sidewall 56 connected to an edge of the top plate 54. The sidewall 56 is provided with a pair of through holes 58. The cover 44 is connected to the base 42 by the pin 46 inserted into the elongated slots 52 of the base 42 and the through holes 58 of the cover 44. The sidewalls 50 and 56 are at the same side of the second member 40, and the second member 40 has an entrance at a side opposite to the sidewalls 50 and 56. The cover 44 has an opening 60, in which an elastic member 62 is provided. The elastic member 62 has an end connected to the cover 44 and a distal end suspended, and an operating portion 64 is formed on the elastic member 62 adjacent to the distal end. The elastic member 62 works for an unlocking device. The cover 44 further has a locking member 66 adjacent to the operating portion 64, which has a stop portion 68 facing the operating portion 64.

An end of the first member 30 enters the second member 40 via the entrance, and the first member is able to be moved between a first position and a second position. At the first position, the first member 30 is closed to the second member 40 and the hook 38 of the latch member 36 engages the stop portion 68 of the locking member 66 to secure the first member 30 at the first position. When the elastic member 62 is pressed downward, the operating portion 64 moves the latch member 36 away to disengage the hook 38 of the latch member 36 with the stop portion 68 of the locking member 66. It makes the first member 30 able to be moved away from the second member 40 and arrive at the second position.

Figure 5:
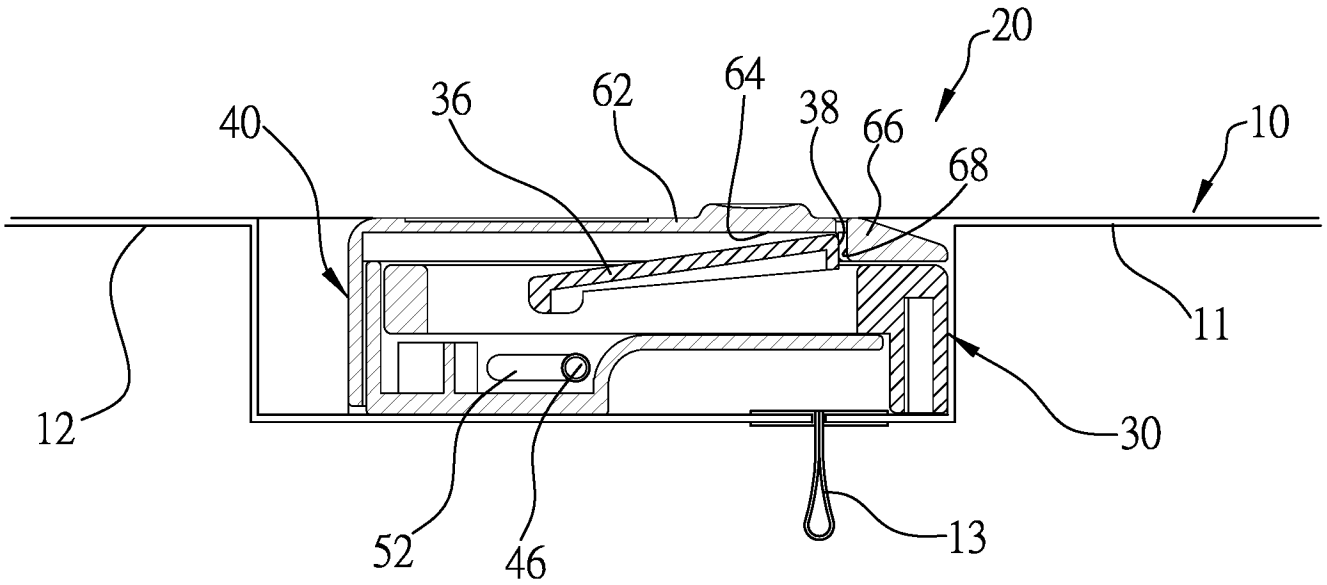
FIG. 5 is a sectional view of the first preferred embodiment of the present invention, showing the first member at the first position.

As shown in FIG. 5, while the first member 30 is being moved toward the first position, the first case member 11 is drawn to the second case member 12 and the flexible member 13 is warped. At the first position, the first case member 11 is closed to the second case member 12 and the hook 38 of the latch member 36 engages the stop portion 68 of the locking member 66 to secure the first member 30 at the first position. At this time, the luggage 10 has a small chamber to store goods.

Figure 6:
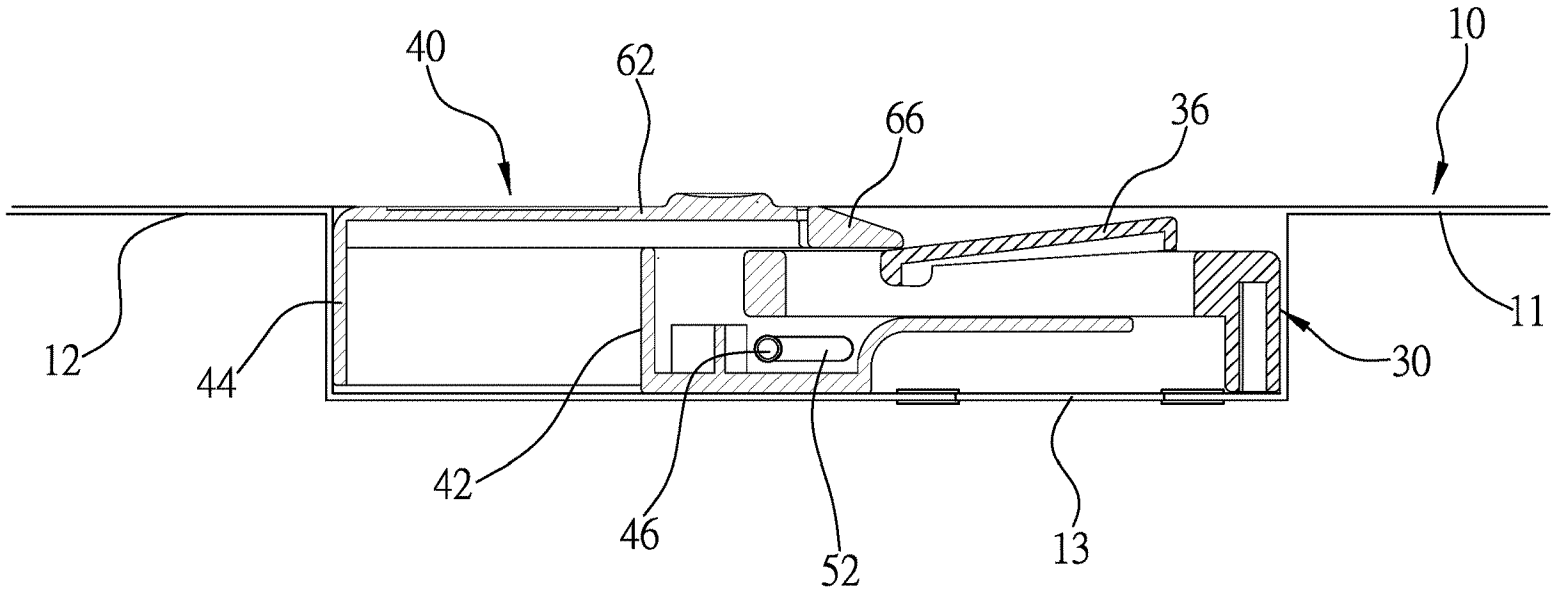
FIG. 6 is a sectional view of the first preferred embodiment of the present invention, showing the first member at the second position.

If the user wants to have a large chamber, he/she only has to press the elastic member 62 to move the latch member 36 downward. As a result, the hook 38 of the latch member 36 disengages the stop portion 68 of the locking member 66, and the first and the second case member 11 and 12 are able to be moved away from each other. As shown in FIG. 6, when the first member 30 is moved to the second position, the flexible member 13 is straightened, and the luggage 10 has a large chamber to store goods.

In operation of narrowing the expandable luggage of the present embodiment, a user only need to press the first case member 11 toward the second case member 12, and the hook 38 of the latch member 36 engages the stop portion 68 of the locking member 66 when the first member 30 arrives at the first position to secure the luggage 10 at a small size. In operation of expanding the expandable luggage of the present embodiment, a user only need to press the elastic member 62 to disengage the hook 38 of the latch member 36 with the stop portion 68 of the locking member 66, and the first and the second case member 11 and 12 are free to move away from each other to expand the luggage 10.

Figure 7:
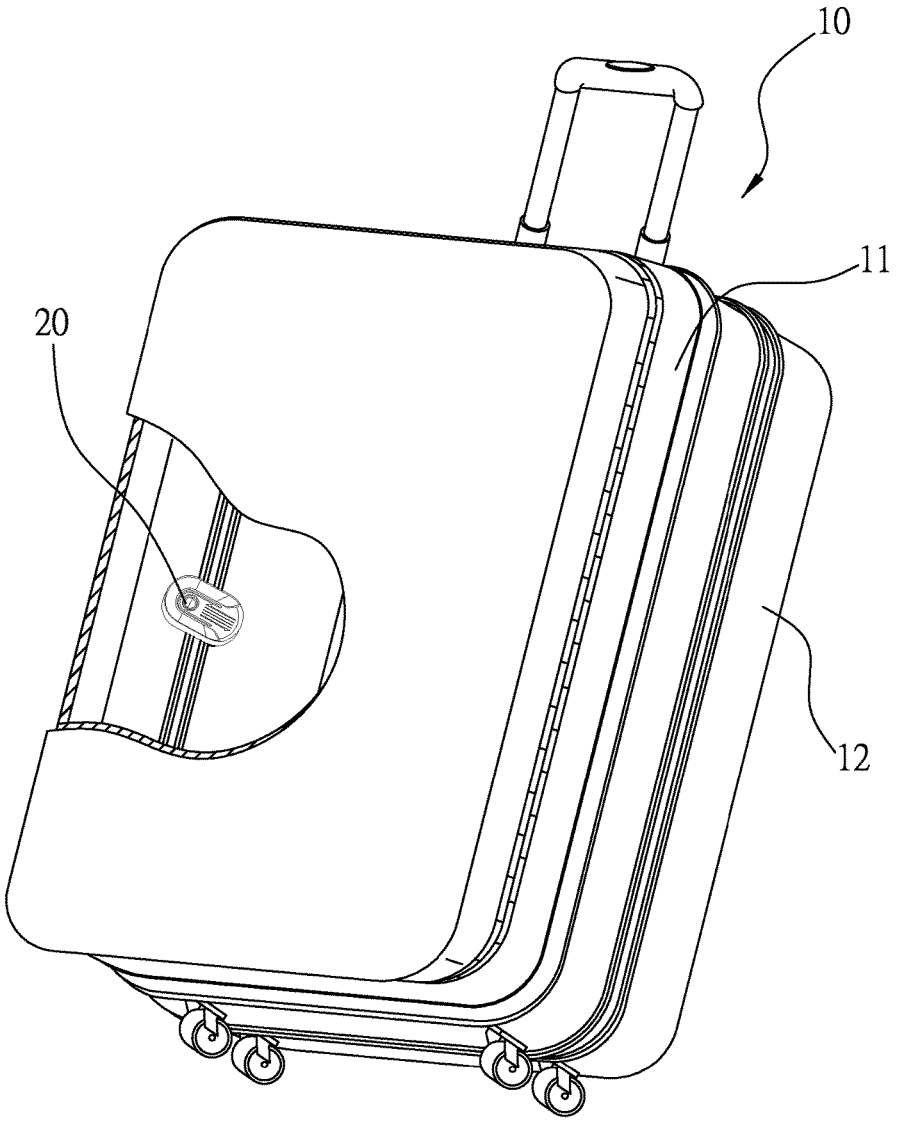
FIG. 7 is a perspective view of a second preferred embodiment of the present invention, showing the controller inside the luggage.

FIG. 7 shows an expandable of the second preferred embodiment of the present invention, which are almost the same as the first preferred embodiment, except that the controllers are provided at interior sides of the first and the second case members 11 and 12.

It must be pointed out that the embodiments described above are only some preferred embodiments of the present invention. All equivalent structures which employ the concepts disclosed in this specification and the appended claims should fall within the scope of the present invention.

What is claimed is:

1. An expandable luggage, comprising:

a first case member;

a second case member;

a flexible member with opposite ends connected to the first and the second case members to form a chamber between the first and the second case members; and a controller having a first member fixed to the first case member, a second member fixed to the second case member and in association with the first member, and an unlocking device, wherein the first member has a latch member with a hook; the second member has an entrance at an end thereof and a locking member with a stop portion inside the entrance; the first member is inserted into the second member via the entrance to be moved between a first position, at which the first member is closed to the second member and the hook of the latch member engages the stop portion of the locking member to secure the first member at the first position, and a second position, at which the first member is moved away from the second member;

wherein the unlocking device is provided at the first member or the second member to be operated to disengage the hook of the latch member with the stop portion of the locking member when the first member is at the first position, whereby the first member is able to be moved to the second position;

wherein when the first member is moved to the first position, the first case member is moved toward the second case member to narrow the chamber; and when first member is moved to the second position, the first case member is moved away from the second case member to expand the chamber.

2. The expandable luggage of claim 1, wherein the first member of the controller has a main body fixed to the first case member; the latch member has an end connected to the main body and a distal end suspended, and the hook is provided at the distal end.

3. The expandable luggage of claim 2, wherein the main body has an opening, and the latch member is provided in the opening.

4. The expandable luggage of claim 1, wherein the second member of the controller has a base fixed to the second case member and a cover connected to the base.

5. The expandable luggage of claim 4, wherein the unlocking device has an elastic member provided on the cover; the elastic member has an end connected to the cover and a distal end suspended; the elastic member has an operating portion adjacent to the distal end, and the locking member is adjacent to the operating portion with the stop portion facing the operating portion.

6. The expandable luggage of claim 4, wherein the second member further has a pin passing through the base and the cover to connect the base and the cover together.

7. The expandable luggage of claim 6, wherein the base is provided with a pair of elongated slots, and the cover is provided with a pair of through holes; the pin is inserted into the elongated slots of the base and the through holes of the cover to make the cover able to be moved related to the base.

8. The expandable luggage of claim 1, wherein the first case member is provided with a recess, in which the first member of the controller is received, and the second case member is provided with a recess, in which the second member of the controller is received.

9. The expandable luggage of claim 8, wherein a height of the controller is equal to or lower than depths of the recesses.

10. The expandable luggage of claim 1, wherein the first member and the second member of the controller are provided at interior sides of the first case member and the second case member respectively.

11. The expandable luggage of claim 4, wherein the base has a bottom plate and a sidewall connected to an edge of the bottom plate; the cover has a top plate and a sidewall connected to an edge of the top plate; the bottom plate of the base is fixed to the second case member; the sidewalls of the base and the cover are at the same side of the second member, and the entrance is formed at a side opposite to the sidewalls.

12. The expandable luggage of claim 4, wherein the second member further includes a pin passing through the sidewalls of the base and the cover to connect the base and the cover together.

* * * * *